United States Patent [19]

Shannon

[11] Patent Number: 4,806,184

[45] Date of Patent: Feb. 21, 1989

[54] WALLPAPER APPLICATOR

[76] Inventor: Brian P. Shannon, 9000 Bissonnett, #304, Houston, Tex. 77074

[21] Appl. No.: 91,262

[22] Filed: Aug. 31, 1987

[51] Int. Cl.[4] ..... E04B 2/00

[52] U.S. Cl. ..... 156/71; 7/105; 52/746; 156/64; 156/191; 156/204; 156/378; 156/459; 156/494; 156/523; 156/576; 156/577; 156/579

[58] Field of Search ..... 7/105; 52/746; 156/64, 156/191, 71, 204, 378, 494, 576, 579, 577, 523, 459

[56] References Cited

U.S. PATENT DOCUMENTS

| | | | |
|---|---|---|---|
| 986,310 | 3/1911 | Phillips | 156/494 |
| 4,210,485 | 7/1980 | Lake | 156/577 |

*Primary Examiner*—John J. Gallagher
*Attorney, Agent, or Firm*—Kenneth A. Roddy

[57] ABSTRACT

A hand-held wallpaper applicator for supporting and applying sheet material to a wall or other surface comprises a hand held support member having a hand grip portion and a flat generally rectangular base portion with an elongate separable roller assembly rotatably and removably carried by the support member. The roller assembly is adapted to receive and releasably secure one end of a strip of wallcovering material thereon and to receive the remaining strip material thereon in a rolled condition. A laterally adjustable elongate tubular pressure contact member is removably carried at the forward end of the support member parallel with the roller assembly for contacting and applying pressure to the wallcovering material as it is scrolled off the roller assembly. A tensioning mechanism on the support member applies resilient pressure to the material rolled on the roller assembly and maintains the remaining material in the rolled condition as the material is being scrolled off the roller assembly. The tensioning mechanism is movable to engage the rolled material and a position out of engagement therewith remote from the roller assembly to remove and install the roller assembly. A level is carried on the pressure contact member for indicating the positioning of the sheet material upon the surface being covered. The material is scrolled onto the roller assembly by a removable hand crank.

18 Claims, 5 Drawing Sheets

FIG. 1
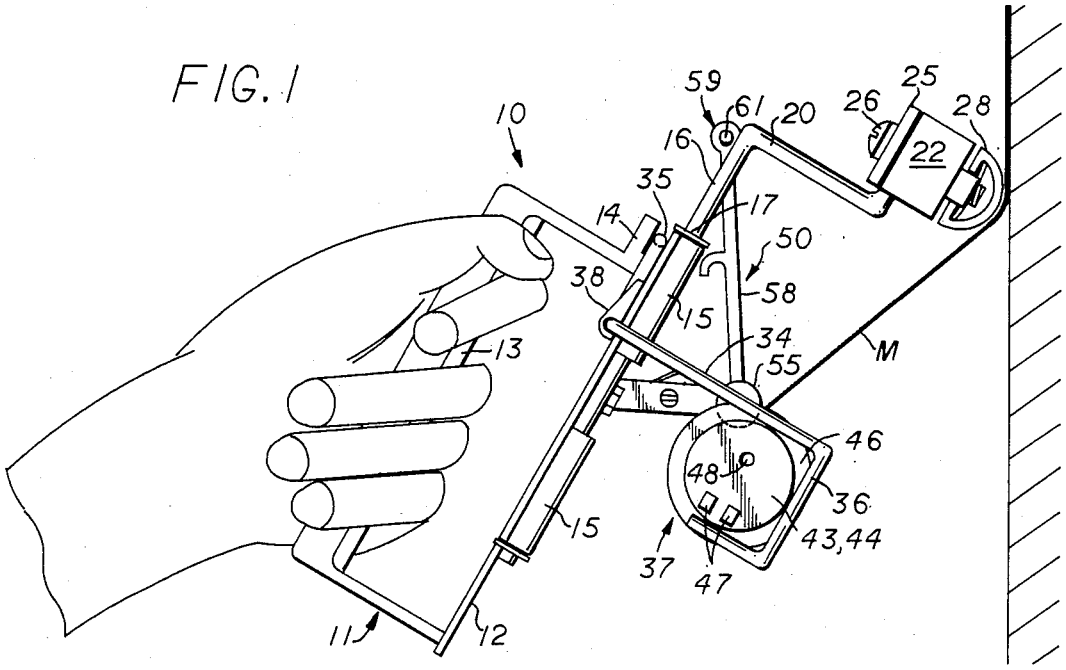
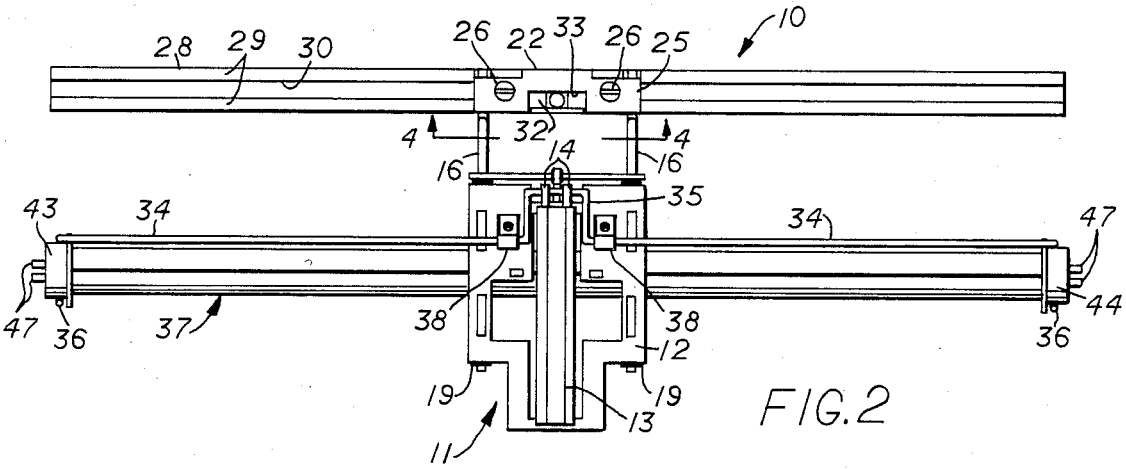
FIG. 2
FIG. 3
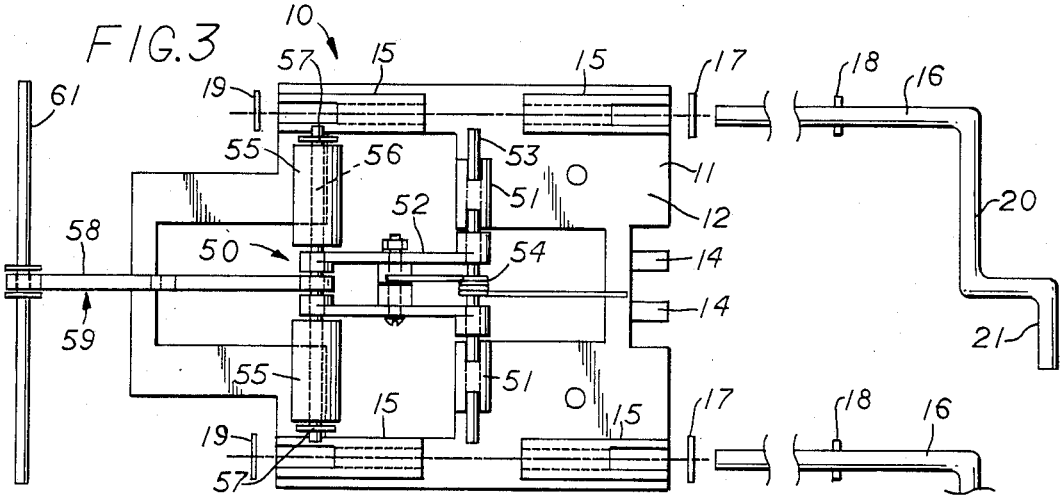

WALLPAPER APPLICATOR

BACKGROUND OF THE INVENTION

1. FIELD OF THE INVENTION

The present invention relates generally to apparatus for applying wallcovering sheets to walls or other surfaces, and more particularly to a hand held wallpaper applicator upon which the material is scrolled on and off and supported while being applied and which has leveling means to correctly position the material and applicator and pressure means for providing pressure to assure adhesion between the surface and the wallcovering material.

2. BRIEF DESCRIPTION OF THE PRIOR ART

Adhesive coated or prepasted wallcovering referred to herein are made of vinyl or vinyl coated material consisting of a cloth or paper intrastructure, and have an adhesive or water activated adhesive coating on one side thereof, with a decorative design or pattern on the opposite side. Such sheets or rolls of wallcovering are available in several different widths, but are generally manufactured in 20½ inch widths when retailed in the home consumer market. The adhesive coating on the wallcovering is usually activated by submersion of the wallcovering in a medium consisting of water or, if desired, water and paste.

Application of such moistened, prepasted wallcovering or coated wallcovering requires considerable time and dexterity in order to avoid formation of wrinkles, creases, and tears in the applied sheets or strips. It is also difficult to insure that the sheets of wallcovering are applied in a level or aligned manner on the surface to be papered. Since the sheets must usually be submerged in a water trough and dampened to activate the adhesive paste on the paper prior to application, a large area, equal to the length of the strip of moistened paper, is required so that this dripping strip of paper can be laid out and booked. Furthermore, once the wet paper has relaxed for the time required to allow the paste to be fully activated, the wet strip must be tediously applied to the surface. If the wet strip is not properly applied or aligned level to the surface to be covered, then efforts to detach or manipulate the adhered strip on the surface may cause tearing or damage.

There are several patents which disclose hand-held wallpaper applicators of various construction.

Heinemann, U.S. Pat. No. 302,250 discloses a paper hanger's holder which is a hand-held device having a handle with a bar adapted to support a fan of paper doubled over it, and two clamping bars arranged parallel to and one to either side of the support bar.

Foster, U.S. Pat. No. 630,678 discloses a device for applying wall paper comprising a brush with bristles facing outward and a roller mounted above the brush in a yoke attached to a telescopic handle.

Fritz, U.S. Pat. No. 1,498,618 discloses a paper hanging machine comprising a supporting frame which holds and permits unwinding of the paper over guides and over the slot in a paste container for automatically applying the paste to the paper. A cylindrical brush is mounted at the front of the frame and the device includes a knife which cuts the paper at the end of a single stretch. A spring pressed bar opposite the slot presses the paper against the slot and the pressure of the bar on the paper is manually controlled.

Hale, U.S. Pat. No. 1,639,134 discloses a paper hanging device comprising a rectangular frame having a front section and a rear section hinged together and an operating handle pivotally connected to the frame. A small roller is rotatably supported on the front section and a larger roller is rotatably supported on the rear section. An upright brush is disposed centrally between the rollers. The paper after being pasted is placed on top of the frame and the device is placed against the ceiling with the rear roller serving as a paper carrier and the front roller rolling the paper against the ceiling by drawing the device along the length of the paper.

The present invention is distinguished over the prior art and the above noted patents in particular by a handheld wallpaper applicator having a hand grip portion and a flat generally rectangular base portion with an elongate separable roller assembly rotatably and removably carried thereon which is adapted to receive and releasably secure one end of a strip of wallcovering material thereon and to receive the remaining strip material thereon in a rolled condition. An elongate laterally adjustable tubular pressure contact member is carried at the forward end of the applicator parallel with the roller assembly for contacting and applying pressure to the wallcovering material as it is scrolled off the roller assembly. Tensioning means on the applicator applies resilient pressure to the material rolled on the roller assembly to maintain the remaining material in the rolled condition as the material is being scrolled off the roller assembly. The tensioning means is selectively movable between a position into engagement with the rolled material and a position out of engagement therewith and remote from the roller assembly for allowing the roller assembly to be removed from the applicator. The applicator has level means for indicating the positioning of the sheet material upon the surface being covered and rotary crank means releasably and operatively connected to the roller assembly for rotating same to scroll the remaining strip material thereon in a rolled condition.

SUMMARY OF THE INVENTION

It is therefore an object of the present invention to provide a wallpaper applicator which will facilitate smooth and efficient application of wallcovering.

It is another object of the invention to provide a handheld wallpaper applicator upon which moistened wallcovering is scrolled on and off and comfortably supported thereon.

Another object of the invention is to provide a handheld wallpaper applicator which will apply easily wallcovering quickly and easily to the surface in a manner such that the wallcovering adheres in a wrinkle, creasefree appearance.

Another object of the invention is to provide a handheld wallpaper applicator which will reduce the time and effort required to apply moistened, prepasted wallcovering or coated wallcovering to surfaces.

Another object of the invention is to provide a handheld wallpaper applicator which does not require considerable dexterity to apply wallcovering.

Another object of the invention is to provide a handheld wallpaper applicator which reduces the formation of wrinkles, creases, and tears in the applied sheets or strips of material.

A further object of the invention is to provide a handheld wallpaper applicator which will insure that the sheets of wallcovering are applied in a level or aligned manner on the surface to be papered.

A still further object of the invention is to provide a hand-held wallpaper applicator which is simple in construction, economical to manufacture, and rugged and durable in use.

Other objects of the invention will become apparent from time to time throughout the specification and claims as hereinafter related.

The above noted objects and other objects of the invention are accomplished by a hand-held wallpaper applicator having a hand grip portion and a flat generally rectangular base portion with an elongate separable roller assembly rotatably and removably carried thereon which is adapted to receive and releasably secure one end of a strip of wallcovering material thereon and to receive the remaining strip material thereon in a rolled condition. An elongate laterally adjustable tubular pressure contact member is carried at the forward end of the applicator parallel with the roller assembly for contacting and applying pressure to the wallcovering material as it is scrolled off the roller assembly. Tensioning means on the applicator applies resilient pressure to the material rolled on the roller assembly to maintain the remaining material in the rolled condition as the material is being scrolled off the roller assembly. The tensioning means is selectively movable between a position into engagement with the rolled material and a position out of engagement therewith and remote from the roller assembly for allowing the roller assembly to be removed from the applicator. The applicator has level means for indicating the positioning of the sheet material upon the surface being covered and rotary crank means releasably and operatively connected to the roller assembly for rotating same to scroll the remaining strip material thereon in a rolled condition.

BRIEF DESCRIPTION OF THE DRAWINGS

FIG. 1 is a side elevation of a wallpaper applicator in accordance with the present invention shown being used to apply the wallcovering material to a wall.

FIG. 2 is a top plan view of the applicator of FIG. 1 in smaller scale.

FIG. 3 is a bottom plan view of the wallpaper applicator.

DESCRIPTION OF THE PREFERRED EMBODIMENT

Figure 4:
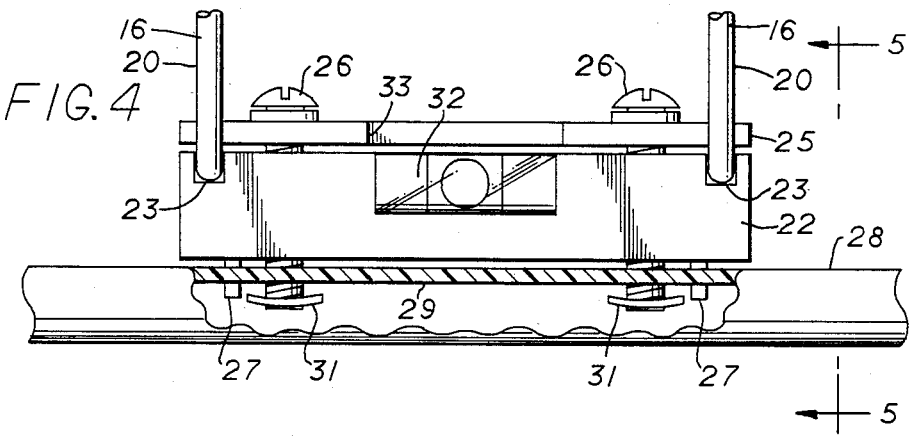
FIG. 4 is a front elevation of the contact tube and support block portion of the applicator.

Referring now to the drawings by numerals of reference, the preferred wallpaper applicator 10 comprises a support handle 11 upon which the various other components of the wallpaper applicator are attached and supported. The support handle 11 is preferably formed as an integral unit having a generally flat rectangular base portion 12 and a central hand grip portion 13 extending longitudinally above the base portion. A pair of parallel, laterally spaced rectangular protuberances 14 protrude from the front of the hand grip portion 13 and are spaced a short distance above the base portion 12. A pair of parallel tubular guide tunnels 15 are formed at the lateral sides of the base portion 12 to depend longitudinally from the bottom surface thereof.

A pair of parallel stabilizer support rods 16, formed of bent wire, are slidably received at one end through the guide tunnels 15 and their other ends extend outwardly from the front of the support handle 11. The stabilizer support rods 16 are each secured against longitudinal movement in the guide tunnels 15 by installation of a metal washer 17 at the front of the guide tunnel which is retained therebetween by a pair of barbs 18 formed on the rod exterior and a round push-on fastener 19 secured at the back end of the guide tunnel on the stabilizer support rod. The extended or forward ends of the stabilizer support rods 16 are bent vertically downward in a generally L-shaped configuration 20 which terminates in a short vertical portion 21.

Figure 5:
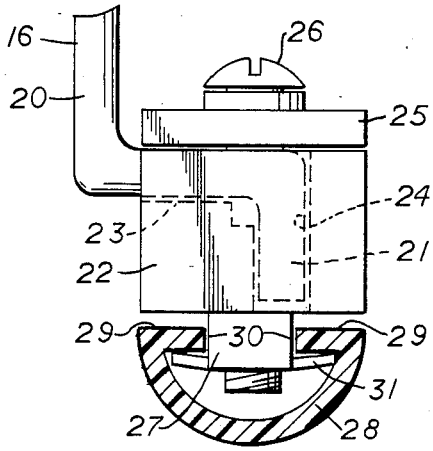
FIG. 5 is a side elevation in partial cross section of the contact tube and support block portion of the applicator taken along line 5—5 of FIG. 4.

A rectangular stabilizer block member 22 as best seen in FIGS. 4 and 5 is releasably attached and supported on the extended ends of the stabilizer support rods 16. The horizontal portion of the L-shaped end 20 is received in slots 23 and the short vertical portion 21 is received in holes 24 formed in the top surface of the stabilizer block 22. The ends of the stabilizer support rods 16 are secured within the slots 23 and holes 24 by a rectangular hold-down plate 25 which is attached flush upon the upper surface of the stabilizer block 22 by machine screws 26 received vertically through holes through the plate and stabilizer block. A pair of parallel alignment pegs 27 depend vertically from the bottom surface of the stabilizer block 22 near each end.

An elongate semicylindrical pressure contact tube 28 is slidably and adjustably secured beneath the rectangular stabilizer block 22 to extend transverse to the support handle 11 and laterally outward from each side thereof. The contact tube 28 is semicircular in cross section and has a pair of inwardly opposed, longitudinal flanges 29 at its open top end defining a central longitudinal slot 30. The slot 30 of the pressure contact tube 28 is slidably received over the depending alignment pegs 27 and machine screws 26 and is tensionally secured to the bottom of the stabilizer block 22 by a rectangular fastener 31 received on the ends of the machine screws 26 within the contact tube 28.

The rectangular fasteners 31 are restricted from rotation about the machine screws 26 by contact with the depending alignment pegs 27. As is best shown in FIG. 5, the contact tube 28 is tensionally and adjustably attached on the underside of the contact stabilizer block 22 by pressure exerted by the metal rectangular fasteners 31 against the underside of the longitudinal flanges 29 of the contact tube 28. The accurate longitudinal alignment of the contact tube 28 relative to the contact stabilizer block 22 is facilitated by the alignment pegs 27 within the center slot 30 formed by the contact tube flanges 29.

A liquid level member 32 having a bubble indicator is secured in the inward top corner of the stabilizer block 22 and the hold-down plate 25 is provided with a cutout on the inward edge allowing the level to be viewed from the top as well as from the front.

An elongate roller support rod 34, formed of bent wire, is secured on the top of the base portion 12 of the support handle 11 and extends laterally outward therefrom perpendicular to the longitudinal axis of the support handle. The roller support rod comprises a central horizontal U-shaped portion 35 and the outward ends of the rod are bent vertically down and form a generally vertical J-shaped portion 36 which faces rearward relative to the central U-shaped portion. An elongate roller assembly 37 (described hereinafter) is rotatably supported at each end within the vertical J-shaped ends 36 of the roller support rod 34.

The central U-shaped portion 35 of the roller support rod 34 is frictionally received between the protuberances 14 of the hand grip portion 13 and the base portion 12 and a pair of clamps 38 secure the lateral extensions of the roller support rod 34 to the base portion. The clamps are secured to the base portion 12 in a conventional manner by bolting. The roller support rod 34 is prevented from rotational movement by the central horizontal U-shaped portion 35 being captured beneath the protuberances 14. The center section of the central horizontal U-shaped portion located between the parallel protuberances is exposed and serves as a receiver for the roller tension mechanism explained hereinafter.

As best shown in FIGS. 7–12, the elongate roller assembly 37 is rotatably supported at each end centrally beneath the support handle 11 by the vertical J-shaped ends of the roller support rod 34. The roller assembly 37 comprises a pair of identical semicylindrical elongate rollers 39 and 40, each of which has a pair of inwardly opposed, longitudinal flanges 41 at its open end defining a central longitudinal slot 42. The rollers 39 and 40 are assembled in opposed relation over the wallcovering material M (explained hereinafter) with the slots 42 together to form a cylindrical roller over which the wallcovering material is scrolled. Cup-shaped end caps 43 and 44 are slidably received one on each end of the assembled rollers.

The end caps 43 and 44 each have a central rectangular boss 45 at their enclosed end which is received within the aligned longitudinal slots 42 formed by the flanges 41 of the rollers to prevent relative movement between the rollers. Each end cap 43 and 44 has a circumferential radial flange 46 surrounding their open end. The end caps 43 and 44 when assembled on the rollers 39 and 40 are rotatably supported in the vertical J-shaped ends 36 of the roller support rod 34. The end cap flanges 46 captured within the J-shaped ends 36 allow rotational movement, but prevent downward, lateral, or longitudinal movement of the roller assembly 37 and facilitate scrolling of the sheet material M on and off the roller assembly. A pair of parallel lugs 47 extend outwardly from the outer surface of each end cap and a hole 48 diametrically opposed from the lugs is provided through the enclosed end of each end cap. One end of a removable hand crank 49 is slidably received in the hole 48 and frictionally between the lugs 47 to transmit rotary motion for scrolling the sheet material M onto the roller assembly 37.

Figure 6:
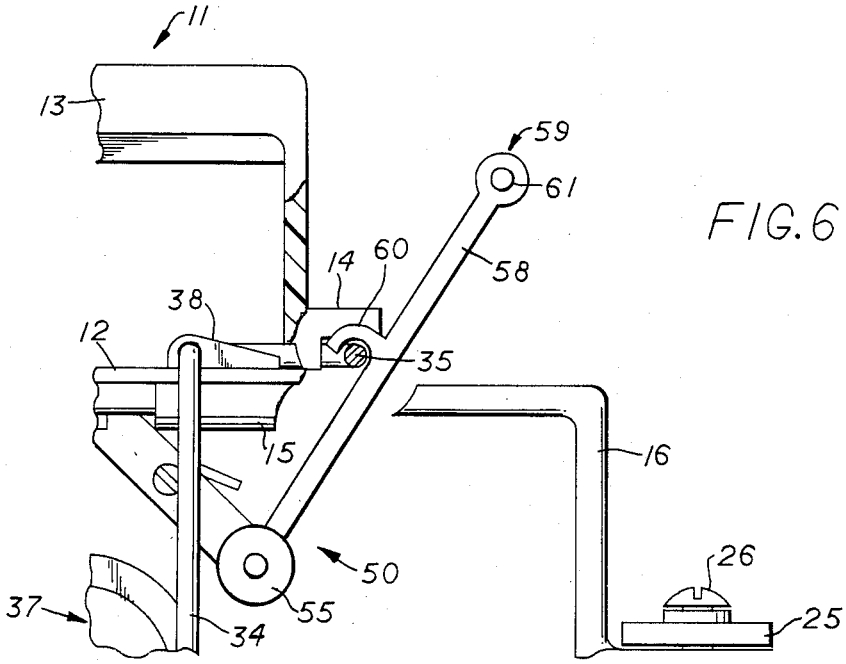
FIG. 6 is a side elevation in partial cross section of the roller tension mechanism of the applicator in a stand-by position.
Figure 12:
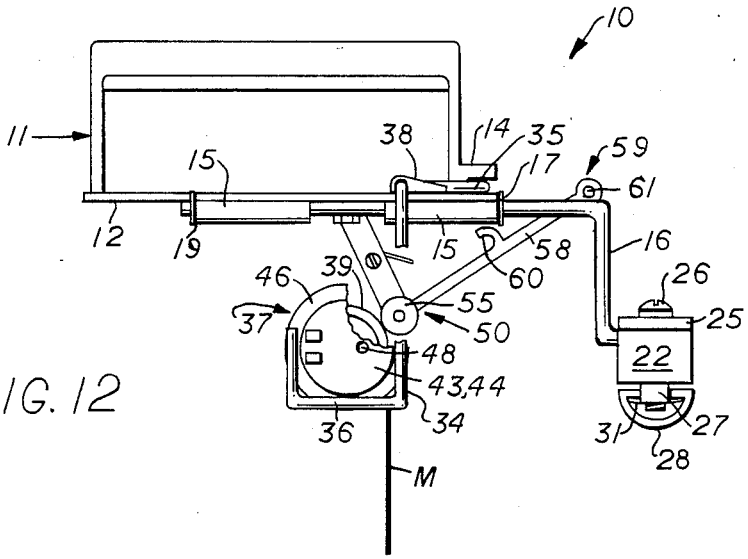
FIG. 12 is a side elevation in partial cross section of the applicator with the roller tension mechanism in the operational position.

As best shown in FIGS. 1, 3, 6, and 12, a spring biased roller tension assembly 50 is disposed centrally on the underside of the support handle base portion 12. A pair of laterally spaced opposed tubular tunnels 51 are formed on the underside of the base portion 12 to depend therefrom transverse to the longitudinal axis of the base portion. One end of an H-shaped yoke 52 is rotatably pinned between the tunnels 51 by a rod 53 extending axially therethrough (FIG. 3). The coil of a torsion spring 54 is retained on the rod 53 between the legs of the yoke 52. One free end of the spring 54 is biased against the underside of the base portion 12 and the other free end engages the central transverse portion of the yoke 52 imparting a torsional resistance to the rotational movement of the yoke 52 about the rod 53. A pair of cylindrical rollers 55 are rotatably mounted at the other end of the H-shaped yoke 52 laterally to each side thereof by a rod 56 extending axially therethrough and retained thereon by a press-on fastener 57 at each end of the rod. The elongate straight leg of a T-shaped handle 59 is rotatably retained on the rod 56 between the legs of the yoke 52. A hook 60 is formed on the straight leg 58 of the T-shaped handle 59 intermediate each end. As best seen in FIGS. 6 and 12, the roller tension assembly applies pressure to the elongate roller assembly 37.

When the sheet material M is being scrolled off the roller assembly 37, the lateral top portion 61 of the handle 59 rests on the stabilizer support rods 16 at the front of the support handle 11 and the torsion spring 54 biases the rollers 55 against the sheet material M to apply the proper tension on the sheet material (FIGS. 1 and 12). When desired, the tension assembly is locked in a "standby" position by raising the top portion 61 of the handle 59 and placing the hook 60 of the handle upon the exposed center section 35 of the roller support rod 34 between the parallel protuberances 14 as illustrated in FIG. 6.

OPERATION

Figure 7:
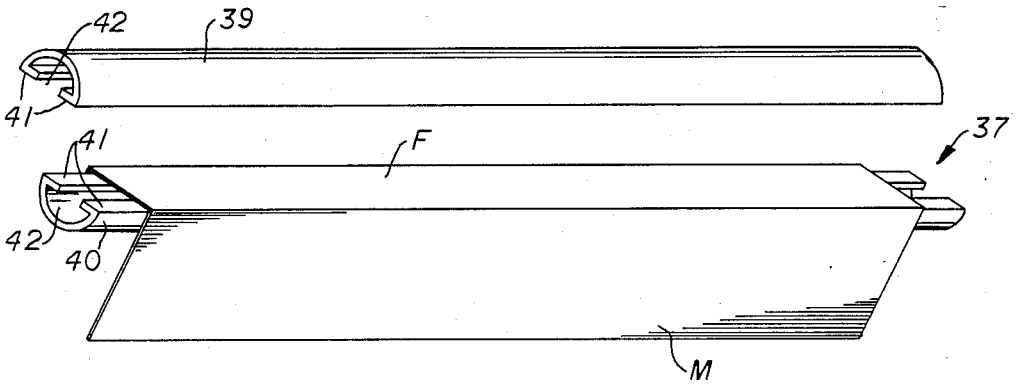
FIG. 7 is a pictorial view of the roller bar assembly of the applicator in a disassembled condition.
Figure 8:
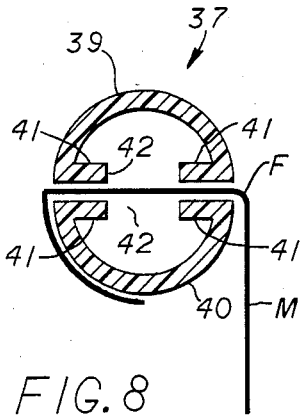
FIG. 8 is a cross section of the roller bar assembly of the applicator in an assembled condition.
Figure 10:
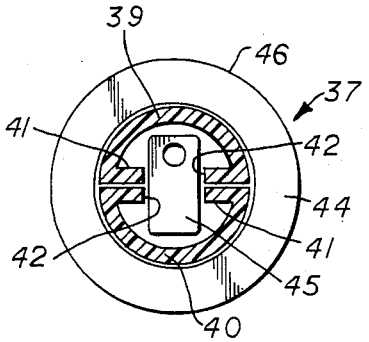
FIG. 10 is a cross section of the roller bar assembly of the applicator with an end cap installed.
Figure 9:
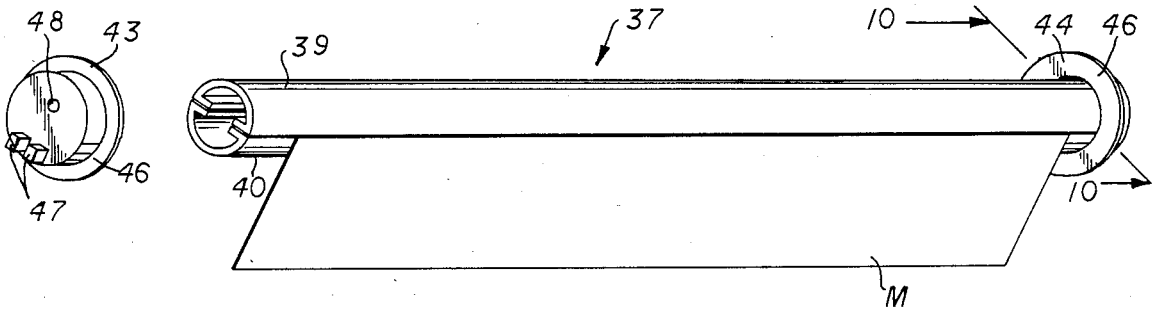
FIG. 9 is a pictorial view of the roller bar assembly of the applicator having the end caps installed thereon.
Figure 11:
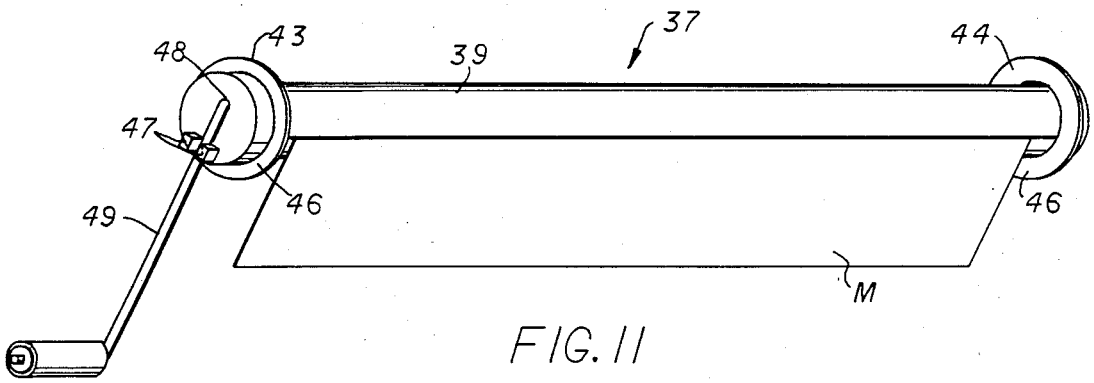
FIG. 11 is a pictorial view of the roller bar assembly of the applicator having the hand crank installed thereon.

Referring now to FIGS. 7–14, in the application of wallcovering material with the present invention, a strip of material M is cut to the required length sufficient to cover the desired surface. The bottom of the strip is folded and placed across the longitudinal flanges 41 of the semicylindrical lower roller 40 of the roller assembly 37. The other roller 39 is placed on top of the material M and lower roller 40 such that the fold F is aligned with the longitudinal edge of the rollers (FIGS. 7 and 8). The end caps 43 and 44 are then positioned upon the ends of the assembled rollers 39 and 40 with the raised bosses 45 received within the slot 42 formed by the flanges 41 (FIGS. 9 and 10). Now the material is held securely between the assembled rollers.

To activate the adhesive or prepasted coating of the material, the material is loosely rolled and submerged in a trough of water or water and paste solution, including the end of the material upon which with the rollers and end caps are attached. The material is thoroughly wetted to insure complete activation of the adhesive coating on the paper.

The roller tension assembly 50 is locked in a "standby" position by raising the top portion 61 of the handle 59 and placing the hook 60 of the handle upon the exposed center section 35 of the roller support rod 34 between the parallel protuberances 14 as illustrated in FIG. 6. The roller assembly 37 is then lifted from the trough and the ends having the end caps installed are placed into the vertical J-shaped ends 36 of the roller support rod 34 as shown in FIG. 12. The pattern side of the material M should be facing out. The hand crank 49 is installed with one end received in the hole 48 and frictionally engaged between the lugs 47. The remaining length of material is then scrolled, by turning the hand crank, from the trough onto the roller assembly with the pattern side of the material facing out. The hand crank is then removed.

The roller tension assembly 50 is released from the standby position by pulling up on the top portion of the T-shaped handle to release the hook 60 from the roller support rod 34. This allows the torsion spring 54 to bias the cylindrical tension rollers 55 against the rolled material and the top portion 61 of the handle 59 rests on the stabilizer support rods 16 at the front of the support handle (FIG. 12). The pressure exerted by the cylindrical rollers 55 of the tension assembly against the surface of the material M is sufficient to prevent the material from prematurely scrolling off of the roller assembly while at the same time allowing the material to be removed through rotation of the roller assembly and complementary rotation of the cylindrical rollers of the tension assembly. The removal of the material from the roller assembly does require that a small force be transmitted through the end of the scrolled material as described hereinafter.

A short length of the free end of the material M is scrolled off the roller assembly by applying a downward force to the end of the material which results in rotation of the roller assembly 37 and complementary rotation of the cylindrical rollers 55 of the tension assembly 50. The material is then positioned under the laterally extending contact tube 28 located at the front of the support handle 11. This is best accomplished by pointing the front of the support handle 11 toward the floor whereby the material M can be gently folded around the curved surface of the contact tube 28. The material is manipulated under the contact tube such that the leading edge of the material is parallel to the longitudinal edge of the contact tube.

Figure 13:
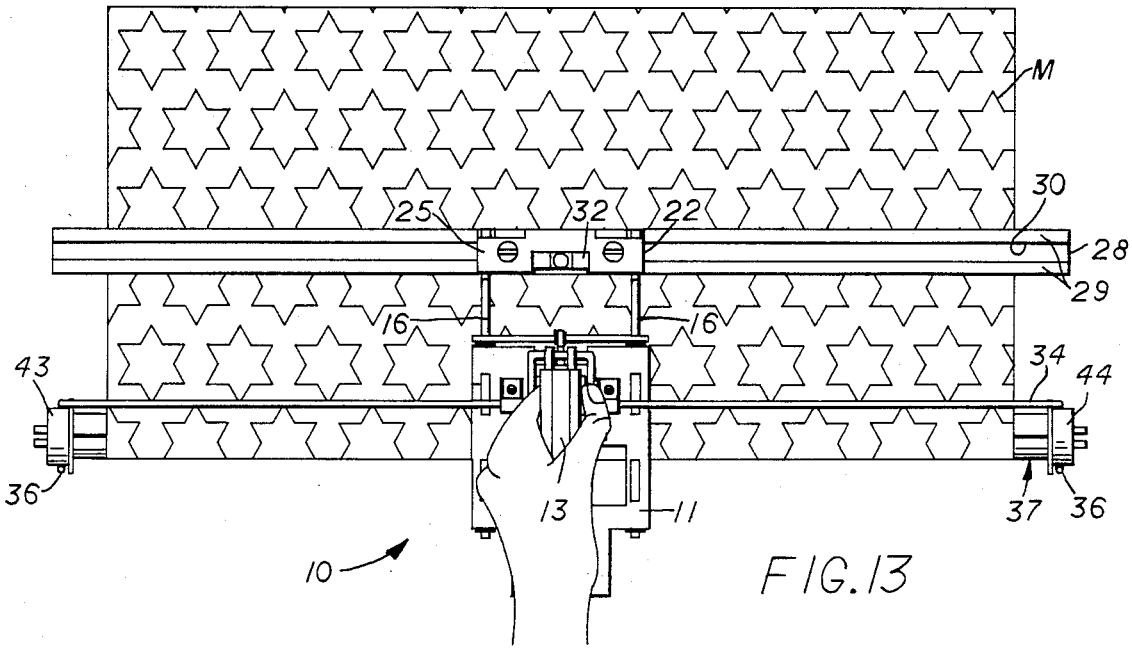
FIGS. 13 and 14 are front elevations showing the applicator applying the wallcovering material to a wall.
Figure 14:
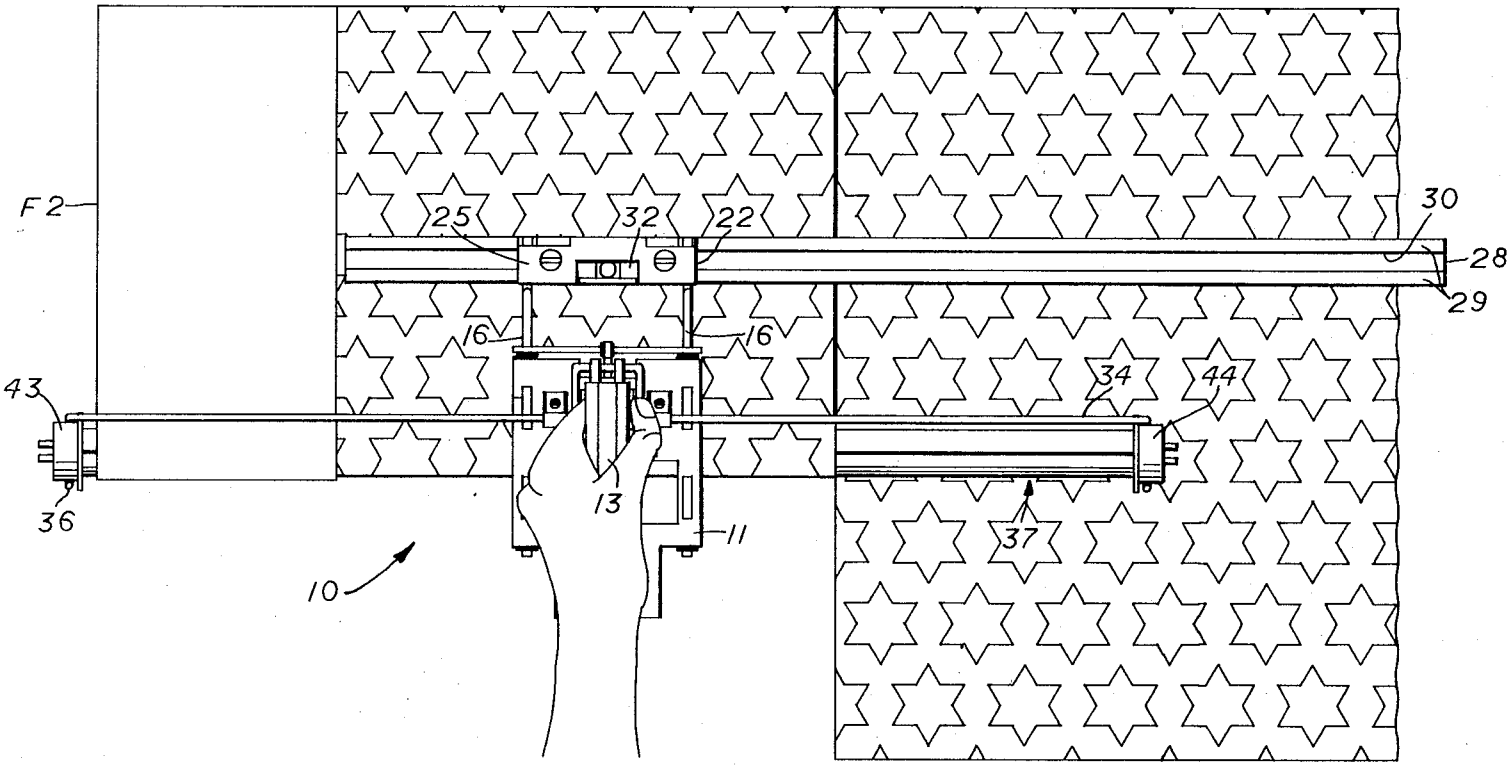

Referring now to FIGS. 1, 13, and 14, the entire assembly and the leading edge of the material is positioned such that the adhesive side of the material M is pressed against the wall or surface to be covered by exerting pressure on the pressure contact tube 28. To assure that the material is correctly aligned, or level, the support handle is manipulated so that the bubble of the liquid level 32 indicates that it is level which also indicates that the contact tube 28 and material are properly aligned on the surface. By manually applying pressure while the assembly is moved in the direction in which the material is to be applied, the rolled material is scrolled off the roller assembly under the rotating tension of the rollers 55 of the tension mechanism 50 and adhered to the surface as it passes beneath the curved surface of the contact tube 28 which is continually pressed against the surface. Movement of the assembly over the length of the surface is continued until the strip of material is completely scrolled off the roller assembly.

In the application of material to the area of a surface located adjacent the intersection of two surfaces, specifically the interior corner of two walls, the above procedure is modified as follows. Prior to the placement of the strip of material between the rollers 39 and 40, the strip of material is folded, top to bottom, with a longitudinally extending fold parallel to the left edge. This fold F2 as seen in FIG. 14, is made so that the pattern side of the material is facing each other and the adhesive or prepasted side fold is facing out.

To insure that the coating on the adhesive side of the folded portion is not damaged or adversely affected during application of the strip to the surface, the contact tube is adjusted such that it does not contact or apply pressure to the adhesive side of the fold. The realignment of the contact tube 28 is accomplished by loosening the two machine screws 26 located on the stabilizer block 22 so that the tube 28 is allowed to slide laterally supported between the tabs 27 and rectangular fasteners 31 in the longitudinal tube slot 30 (FIG. 5). To secure the contact tube at the correct lateral position, the machine screws 26 are retightened to draw the rectangular fasteners against the flanges 29 of the contact tube and engage the contact tube securely against the bottom of the stabilizer block 22.

After activation of the adhesive coating as described above, the apparatus is manipulated such that the material is positioned upon the surface abutting the immediate side of the previously applied strip such that the pattern matches and the seams of the material are abutted (FIG. 14). The assembly is then moved in the direction in which the material is to be applied until the strip of material is completely scrolled off the roller assembly. The folded section of material is then gently opened and pressed to the uncovered surface adjacent the corner such that the material is neatly positioned and adhered about the corner area.

While this invention has been described fully and completely with special emphasis upon a preferred embodiment, it should be understood that within the scope of the appended claims the invention may be practiced otherwise than as specifically described herein.

I claim:

1. A method of applying adhesive or prepasted wallcovering material to a wall or other surface comprising the steps of:

(A) providing a hand-held wallpaper applicator having a hand grip portion and a flat generally rectangular base portion, with an elongate separable roller assembly rotatably and removably carried thereon which is adapted to receive and releasably secure one end of a strip of wallcovering material therein and to receive the remaining strip material thereon in a rolled condition, an elongate laterally adjustable tubular pressure contact member carried at the forward end of the applicator parallel with the roller assembly for contacting and applying pressure to the wallcovering material as it is scrolled off the roller assembly, and tensioning means on the applicator for applying resilient pressure to the material rolled on the roller assembly to maintain the remaining material in rolled condition as the material is being scrolled off the roller assembly, said tensioning means being selectively movable between a position into engagement with the rolled material and a position out of engagement therewith and remote from the roller assembly for allowing the roller assembly to be removed from the applicator, said applicator having level means for indicating the positioning of the sheet material upon the surface being covered and rotary means releasably and operatively connected to the roller assembly for rotating same to scroll said remaining strip material thereon in a rolled condition.

(B) cutting a strip of wallcovering material to the required length sufficient to cover the surface to be covered, (C) folding the bottom of the strip, placing the folded end within the separable roller assembly and securing the roller assembly to the folded end such that the fold is aligned with the longitudinal edge of the roller assembly, (D) loosely rolling the remaining strip of material and submerging it in a trough of water or water and paste solution, including the end of the material upon which the roller assembly is secured, for a sufficient time to throughly wet the material and insure complete activation of the adhesive coating thereon, (E) moving the applicator tension assembly to the remote position and lifting the roller assembly with the folded end secured thereon and placing it into the applicator with the pattern side of the material facing out relative to the roller assembly, (F) installing the rotary means on the roller assembly and rotating it to scroll the remaining strip of material from the trough onto the roller assembly with the pattern side of the material facing out and thereafter removing the rotary means, (G) moving the tensioning means into engagement against the rolled material to prevent the material from prematurely scrolling off of the roller assembly, (H) pulling the free end of the material to scroll a short length of the material off the roller assembly, (I) positioning the free end beneath the tubular pressure contact member at the front of the applicator such that the leading edge of the material is parallel to the longitudinal edge of pressure contact member, (J) positioning the pressure contact member and leading edge of the material against the surface to be covered such that the adhesive side of the material is pressed against the surface by exerting pressure on the pressure contact member while observing the level means and manipulating the applicator to assure that the material is correctly aligned and the pressure contact member is level and properly aligned on the surface (K) manually applying pressure while moving the applicator in the direction in which the material is to be applied and allowing the rolled material to scroll off the roller assembly under the tension of the tensioning means and to become adhered to the surface as it passes beneath the curved surface of the pressure contact member, (L) continuing movement and constant pressure against the surface over the length of the surface until the strip of material is completely scrolled off the roller assembly, and (M) thereafter cutting another strip and repeating previously recited steps 2 through 12.

2. The method according to claim 1 including additional steps for application of material to the area of a surface located adjacent the intersection of two surfaces, such as the interior corner of two walls, said additional steps comprising;

after applying a first strip of material as recited in steps 2 through 12 adjacent the corner, repeating previously recited steps (A) and (B) and, prior to the placement of the folded strip of material between the roller assembly as recited in step (C), folding the strip of material top to bottom with a longitudinally extending fold parallel to the left edge such that the pattern side of the fold is facing each other and the adhesive or prepasted side fold is facing out, then laterally adjusting the pressure contact member to a position adjacent the longitudinal fold where the end of the member does not contact or apply pressure to the adhesive side of the fold, thereafter repeating previously recited steps (D) through (I), and said step of positioning the pressure contact member and leading edge of the material against the surface to be covered as recited in step (J) including the additional step of positioning the material upon the surface and abutting the side of the previously applied strip such that the pattern matches and the seams of the material are abutted, and thereafter repeating previously recited steps 11 and 12 until the strip of material is completely scrolled off the roller assembly, and thereafter gently opening the folded section of material and pressing it to the uncovered surface adjacent the corner such that the material is neatly positioned and adhered about the corner area.

3. A hand-held wallpaper applicator for supporting and applying sheet material to a wall or other surface comprising;

a hand held support member having a hand grip portion and a flat generally rectangular base portion, a material roller member rotatably and removably carried by said support member, said material roller adapted to receive and releasably secure one end of a strip of wallcovering material therein and to receive the remaining strip material thereon in a rolled condition, pressure contact means adjustably and removably carried at the forward end of said support member parallel with said material roller for contacting and applying pressure to the wallcovering material as it is scrolled off said material roller, and tensioning means carried on said support member for applying resilient pressure to the material rolled on said material roller to maintain the remaining material in the rolled condition as the material is being scrolled off said material roller, said tensioning means comprising a yoke member pivotally connected at one end on said support member and having a pair of cylindrical rollers rotatably mounted at its other end laterally to each side thereof, a torsion spring operatively connected at the pivotal connection to urge said cylindrical rollers toward and into engagement against said material roller for applying resilient pressure to the material rolled thereon, and a handle member pivotally connected to said yoke and cooperative therewith for selectively moving said cylindrical rollers between a position into engagement with the rolled material and a position out of engagement therewith spaced remote from said material roller for allowing said material roller to be removed from said support member.

4. An applicator according to claim 1 including level means carried on said contact means for indicating the positioning of the sheet material upon the surface being covered.

5. An applicator according to claim 4 in which said level means comprises a liquid level.

6. An applicator according to claim 1 including rotary means releasably and operatively connected to said material roller for rotating same to scroll said remaining strip material thereon in a rolled condition.

7. An applicator according to claim 6 in which said rotary means comprises a hand crank.

8. An applicator according to claim 1 in which said pressure contact means comprises an elongate tubular member extending transverse to said support member and laterally outward from each side thereof and having a length slightly greater than the width of the strip material, said tubular member being laterally adjustable relative to said support member.

9. An applicator according to claim 8 in which said tubular member is adjustably and removably carried on a pair of parallel rod members extending forward from said support member.

10. An applicator according to claim 9 in which said tubular member is adjustably and removably connected to a rectangular block member removably attached to a pair of parallel rod members connected to said support member and extending forward therefrom, said block member having a pair of laterally spaced alignment elements depending from the bottom surface thereof, and said tubular member having a longitudinal slot slidably received on said alignment elements and being releasably and adjustably secured to said block member by releasable fasteners.

11. An applicator according to claim 10 including level means carried on said block member for indicating the positioning of the sheet material upon the surface being covered.

12. An applicator according to claim 1 in which said material roller comprises an elongate cylindrical roller assembly rotatably and removably carried beneath said support member and extending transverse thereto and laterally outward from each side thereof and having a length slightly greater than the width of the strip material.

13. An applicator according to claim 12 in which said roller assembly is rotatably and removably supported at each end on the ends of a support rod member releasably attached to said support member at its center and the ends of which extend laterally to each side thereof.

14. An applicator according to claim 13 in which said roller assembly comprises a pair of semicylindrical elongate rollers each of which has a pair of inwardly opposed, longitudinal flanges defining a central longitudinal slot, said roller being removably connected in opposed relation over the said one end of the wallcovering material with the slots together to form a separable cylindrical surface over which the said remaining wallcovering material is scrolled.

15. An applicator according to claim 14 in which said rollers are removably connected in opposed relation over the said one end of the wallcovering material with the slots together by a pair of cup-shaped end cap members slidably received over the opposite ends of said rollers, said end caps each have a central rectangular boss at their enclosed end which is received within the aligned longitudinal slots formed by the flanges of said rollers to prevent relative movement between said rollers.

16. An applicator according to claim 15 in which the laterally extending ends of said support rod member terminate in a generally J-shaped configuration which extends downward and faces rearward relative to the laterally extending portion, each said end cap has a circumferential radial flange surrounding their open end, and said end caps when assembled on said rollers are rotatably supported in the J-shaped ends of said support rod such that the end cap flanges are disposed between the J-shaped ends to allow rotational movement of said roller assembly while preventing downward, lateral, or longitudinal movement of the roller assembly and facilitate scrolling of the sheet material on and off said roller assembly.

17. An applicator according to claim 16 including rotary means removably and operatively connected to said end caps for rotating same to scroll said remaining strip material on said roller assembly in a rolled condition.

18. An applicator according to claim 17 in which said rotary means comprises a hand crank.

* * * * *